US006464331B1

(12) United States Patent
Van Doorn et al.

(10) Patent No.: US 6,464,331 B1
(45) Date of Patent: Oct. 15, 2002

(54) METHOD OF PRINTING A SUBSTRATE AND A PRINTING DEVICE SUITABLE FOR THE USE OF THE METHOD

(75) Inventors: André Van Doorn, Helmond; Eduard Theodorus Hendricus De Grijs, Venlo; Clemens Theodorus Weijkamp, Zijtaart; Jacob Albert Westdijk, Venlo, all of (NL)

(73) Assignee: Oce-Technologies B.V., Ma Venlo (NL)

( * ) Notice: Subject to any disclaimer, the term of this patent is extended or adjusted under 35 U.S.C. 154(b) by 0 days.

(21) Appl. No.: 09/637,081

(22) Filed: Aug. 11, 2000

(30) Foreign Application Priority Data

Aug. 12, 1999 (NL) ..... 1012813

(51) Int. Cl.[7] ..... B41J 2/15
(52) U.S. Cl. ..... 347/41; 347/12
(58) Field of Search ..... 347/41, 12, 15, 347/43, 40, 9, 14, 16; 358/502, 1.2

(56) References Cited

U.S. PATENT DOCUMENTS

| | | | | |
|---|---|---|---|---|
| 4,528,576 A | | 7/1985 | Koumura et al. | 347/15 |
| 4,967,203 A | * | 10/1990 | Doan et al. | 347/41 |
| 4,999,646 A | * | 3/1991 | Trask | 347/41 |
| 5,500,661 A | * | 3/1996 | Matsubara et al. | 347/41 |
| 6,170,932 B1 | * | 1/2001 | Kanaya et al. | 347/41 |

FOREIGN PATENT DOCUMENTS

| | | |
|---|---|---|
| EP | 0925950 A2 | 6/1996 |
| EP | 0917955 A1 | 5/1999 |

* cited by examiner

*Primary Examiner*—Lamson Nguyen
(74) *Attorney, Agent, or Firm*—Birch, Stewart, Kolasch & Birch, LLP

(57) ABSTRACT

A method of printing a substrate with an inkjet printing device which utilizes at least one print head provided with at least two rows of nozzles, wherein substantially fixed locations on the substrate, which locations form a regular field of pixel rows and pixel columns, are provided with ink drops image-wise, the resolution of the pixel columns being greater than the resolution of the rows of nozzles, so that p, where p is equal to the quotient of the resolution of the pixel columns and the resolution of the rows of nozzles, is an integer greater than or equal to 2, comprising a first printing stage in which a strip of pixel rows is provided with ink drops, whereafter the print head is displaced in a direction substantially parallel to the pixel columns, and a second printing stage in which the strip is provided with supplementary ink drops, wherein the print head is displaced over a distance such that the same is equal to the width of a number of pixel rows selected from the set:

$$\pm(i+kp)$$

where i is the set of integers greater than or equal to 1 and less than or equal to (p−1) and k is a natural number.

10 Claims, 11 Drawing Sheets

METHOD OF PRINTING A SUBSTRATE AND A PRINTING DEVICE SUITABLE FOR THE USE OF THE METHOD

BACKGROUND OF THE INVENTION

The present invention relates to a method of printing a substrate with an inkjet printing device which comprises at least one print head provided with at least two rows of nozzles, wherein substantially fixed locations on the substrate, which locations form a regular field of pixel rows and pixel columns, are provided with ink drops image-wise, the resolution of the pixel columns being greater than the resolution of the rows of nozzles, so that p, where p is equal to the quotient of the resolution of the pixel columns and the resolution of the rows of nozzles, is an integer greater than or equal to 2. The method comprises a first printing stage in which a strip of pixel rows is provided with ink drops, whereafter the print head is displaced in a direction substantially parallel to the pixel columns, and a second printing stage in which the strip is provided with supplementary ink drops. The present invention also relates to a printing device suitable for the use of the method.

A printing method is known from U.S. Pat. 5,640,183. A known problem in inkjet printing devices is that deviations of individual nozzles may cause disturbing faults in the printed image. For example, a nozzle deviation may result in ink drops leaving the nozzle at the wrong angle ("skew jets"), so that they occupy a different place on the substrate with respect to the center (the normal position) of the fixed locations (pixels), or result in ink drops with a deviant volume, so that too much or too little ink reaches the substrate. This method is used to mask the faults. The print heads used for the use of this method are provided with two rows of nozzles each having a resolution (number of nozzles per unit of length) equal to half the required printing resolution (number of fixed locations per unit of length) in a direction parallel to the pixel columns, and which together, by occupying an interlaced position with respect to one another, form a print head with the required printing resolution. Each row of nozzles of a print head is provided with a number of extra nozzles. When a strip of pixel rows of the substrate is printed by the known method, a series of successive nozzles is selected in the first printing stage from the set of the rows of nozzles of a print head, the number of nozzles in this series being equal to the total number of nozzles of the print head less the number of extra nozzles. If a print head is provided with two rows of 50 nozzles and 3 extra nozzles per row (so that the total number of nozzles is equal to 106), a series of 100 successive nozzles is selected with which a strip in a width of 100 adjoining pixel rows of the substrate is printed. After this first printing stage, a new series of 100 successive nozzles is selected from the available 106 nozzles of the print head. There are thus 7 different options for selecting a second series, i.e. the same series as used in the first printing stage and one of the other 6 possible series of 100 successive nozzles. A choice from these 7 options is made at random. After the choice has been made, the print head is displaced with respect to the substrate in a direction substantially parallel to the pixel columns over a distance corresponding to the selected second series of successive nozzles. The relevant strip is then provided with supplementary ink drops in the second printing stage. By printing each strip of pixel rows of the substrate with a plurality of sub-images, each of said images being printed by a series of successive nozzles chosen at random, any printing faults due to deviations of nozzles are distributed at random over the substrate so that they are less visible to the human eye.

A significant disadvantage of the known method is that as a result of the random choice there is an appreciable risk that a pixel row may be printed entirely with ink drops having the same fault, for example because they occupy a different position with respect to the normal position. Consequently, linear faults may occur in the image. The human eye is very sensitive to such linear faults and these faults are thus found to be disturbing in the printed image. A linear fault forms in any case if the first and second (and any following) series of successive nozzles are identical in the printing of a strip of pixel rows so that all the ink drops printed in one pixel row originate from one specific nozzle. It has also been found that within one print head there are many nozzles which have substantially the same deviations, i.e. they result in ink drops printed with the same fault. Consequently there is a considerable risk of linear faults when the known method is used.

Another disadvantage of the known method is that prior to the second and any following printing stages the substrate must be displaced very accurately over a distance which, depending on the choice of the second series of successive nozzles, varies at random with the width of 0, 1 or a number of pixel rows (a maximum of 6 in the above-described example). A shift of this kind is obtained by moving the paper with respect to the print head by means of a motor. These small shifts chosen at random mean that the paper transport must meet very stringent requirements with respect to accuracy.

Finally, the printing device productivity is reduced with respect to the maximum obtainable productivity since a number of nozzles in each row must be reserved as extra nozzles to make it possible for a random choice to be made for the second and any subsequent series of nozzles.

SUMMARY OF THE INVENTION

The object of the present invention is to obviate these disadvantages. To this end, a method has been developed wherein the print head is displaced over a distance being equal to the width of a number of pixel rows selected from the set:

$$\pm(i+kp) \qquad \text{(formula 1)}$$

where i is the set of integers greater than or equal to 1 and less than or equal to (p−1), k is a natural number and p is equal to the quotient of the resolution of pixel columns and the resolution of rows of nozzles, wherein the resolution of the pixel columns is greater than the resolution of the rows of nozzles.

The present method is based on the realization that it is better to use the systematics of the deviations of the nozzles of the print head to mask printing faults than try to break through the same by a random choice as known from U.S. Pat. No. 5,640,183. The systematics governing the deviations of the nozzles may comprise a number of distinguishable forms of regularity.

First, it has been found that the deviation of the nozzle is substantially constant in time, irrespective of the intensity of the use of the nozzle. In other words, a nozzle will impart substantially the same fault to each drop ejected during the life of the print head. In addition, the deviations of the different nozzles within one row of a specific print head have been found to be not independent of one another in many types of print heads. It has been found that the deviation of an individual nozzle is substantially equal to the deviations of the adjoining nozzles within the same row. For example, if nozzle i in the first row of a print head has a deviation resulting in an ink drop originating from the same nozzle deviating from the normal position on the substrate by a distance of 20 $\mu$m, then the ink drops originating from the nozzles i−1 and i+1 will result in ink drops differing by about 20 $\mu$m from the normal position. It has also been found that the deviations of the individual nozzles within one row frequently have a slow progression, so that not only the directly adjoining nozzles within one row have substantially the same deviations, but also the more distant nozzles. The deviation progress may also be said to be periodic, so that even nozzles very far away from one another have practically the same deviation. As a result of these forms of regularity, there may be many nozzles within one row which exhibit substantially the same deviations. The reason for this regularity is not entirely clear. One reason for the skew jets might be that such print heads are formed by stretching a foil formed with the nozzles over a base. Since this foil can never be stretched completely flat, there may be convexities therein (for example in the form of a corrugated pattern) so that ink drops are ejected from the nozzle at an angle deviation. Another reason might be the semi-continuous production process of such foils, resulting in periodic deviations.

The result of such regularities is that when the known method is used there is a great risk that a pixel row will be provided with ink drops all having the same fault, so that disturbing linear faults may occur in the image. By not using a random choice for the shift of a print head between the first and second (and any following) printing stages, but by making a selection from the set of shift distances given by formula 1, the ink drops printed on one pixel row are, at all times, prevented from all having the same fault. Consequently no disturbing linear faults will form in the image. It has also been found that the masking of faults due to incorrectly placed ink drops (skew jets) is better than when the known method is used.

In one preferred embodiment, the shift distance is equal to the width of a number of pixel rows where k is a natural number equal to or less than 20. The reason for this is that the masking of skew jets, the most common fault, is better the smaller the displacement distances. In another preferred embodiment, k is less than or equal to 10, so that the visible effects of any deviations of the nozzles can be masked even better. If k is smaller than or equal to 5, masking is further improved. The best masking of any deviation is finally obtained when k is equal to 0, so that the displacement is over a distance equal to the width of one pixel row.

For the use of the method according to the present invention, it is not essential for the second printing stage in which a number of pixel rows is provided with supplementary ink drops, to follow directly on the first printing stage. It is quite possible that first a number of strips of the substrate will be provided with a first series of ink drops, whereafter the pixel rows in each of these strips are provided with a supplementary second series of ink drops in a following printing stage. It is essential that the position occupied by the print head during the following printing stage, in order to provide a specific strip of pixel rows with the supplementary ink drops, should be selected in accordance with formula 1 with respect to the position occupied by the print head in printing the first series of ink drops on the pixel rows of said strip.

An arbitrary choice can be made from the set of shift distances given by formula 1. If an image is formed on a substrate by printing a number of strips, a different choice can be made for each of the strips. In principle, the choice for a shift distance for each of these strips can be made at random (from the set given by formula 1). However it has been found that the selection of one fixed shift distance for each of the strips also results in good masking of any printing faults. This is of course related to the systematics of the deviations of the nozzles. An important advantage of this is that in principle one fixed shift of a print head between each of the printing stages required to print a strip will be all that is required. A fixed shift means that the paper transport does not have to meet such strict requirements. Also, in principle, no extra nozzle need be added to a row, so that a print head can be used without loss of productivity.

It has surprisingly been found that the nozzle deviations may be subject to a third form of regularity. It has been found that the deviation patterns of corresponding rows of nozzles of different print heads produced in the same way may significantly correspond. If, for example, a 600 n.p.i. (nozzles per inch) print head consists of 3 rows of 200 nozzles, it appears that the deviations of the nozzles of the first row of this print head correspond substantially to the deviations of the first row of each following print head produced in the same way. The same naturally applies to all the second rows and all the third rows of these print heads. The result, using a number of print heads in a printing device, which print heads satisfy this third form of regularity, is that even linear faults may occur if the known method is used, when ink drops are printed in one pixel row originating from different print heads. By using the method according to the present invention for a set of print heads of this kind as well, i.e. by coordinating in accordance with formula 1 the relative positions of the two or more print heads used for printing a pixel row of the substrate in the different printing stages, linear faults are at all times prevented from forming in the image.

The present invention also relates to an inkjet printing device adapted for using the method according to the present invention. In a preferred embodiment, the print head comprises two rows of nozzles. By arranging for these rows to occupy an interlaced position, even using such rows of low resolution, it is possible to make a print head having a higher resolution, a double resolution in this case. In a further preferred embodiment, each row of nozzles of a print head of this kind has a resolution equal to half the resolution of the pixel columns.

In another preferred embodiment the printing device comprises at least two print heads. If a printing device contains a plurality of print heads, the present invention can be further utilised. This is apparent from the following. For use of the method according to the present invention, it is not essential for the first and second (and any following) printing stages to follow one another directly. This means that the different printing stages can also be performed by different print heads (which, if they were produced in a comparable manner, correspond significantly with respect to deviation pattern). It has also been found that the shift of the print head between the various printing stages may also be a fixed shift, for example always (i.e. for each strip of the substrate) equal to the width of one pixel row. This means that the method according to the invention can also be used by printing each sub-image in a pixel row with a separate print head, the mutual shift of the print heads already being embodied in the fixed arrangement of the print heads in the printing device scanning carriage. This means that the paper transport can be made very rugged, because it is no longer necessary to shift an individual print head with respect to the substrate over a distance equal to the width of one or a few pixel rows between each of the printing stages. A concomitant advantage of this printing device is that printing of the sub-images no longer requires separate printing stages for each sub-image, and instead, all the images can be printed in one printing stage. Of course given the correct arrangement of the various print heads, for example disposed next to one another in a scanning carriage with mutual positioning (in the direction parallel to the pixel columns) selected in accordance with formula 1, all the sub-images can each be printed with a separate print head in one printing stage, i.e. in one movement of the scanning carriage.

If a pixel row is printed with ink drops originating from two or more different print heads, then in a preferred embodiment the position of each following print head differs from the position of the print head used in the first printing stage by not more than the distance where k is an integer less than or equal to 20. In another preferred embodiment, these mutual positions do not differ by more than the distance where k is less than or equal to 10, so that the visible effects of any nozzle deviations can be masked even better. Masking is further improved if these mutual positions of pixel rows do not differ by more than the number where k is less than or equal to 5. The best masking of any deviations is finally obtained when k is equal to 0, so that the mutual positions do not differ by more than one pixel row.

Just as in the known method, using the method according to the present invention, a first sub-image is now printed with a specific print head on a strip of pixel rows of the substrate, whereafter the strip is provided with the other sub-images in one or more following printing stages. Assuming that the complete image can be printed by printing diluted sub-images which complement one another in three printing stages, if a print head used for the purpose is constructed from three rows of nozzles each having a resolution equal to one-third of the required printing resolution (p=3), the number of pixel rows over which the print head must be displaced after the first printing stage has taken place can be selected from $$\pm(i+kp)$$

where i=1 or i=2 (=p−1) and k is a natural number=

$$\pm(1+k3),\pm(2+k3)=$$

$$\pm(1,4,7,\ldots),\pm(2,5,8,\ldots)=$$

$$(\ldots -8,-7,-5,-4,-2,-1,1,2,4,5,7,8,\ldots)$$

An arbitrary choice can be made from this set, for example a shift distance equal to the width of 1 pixel row (i=1 and k=0). Applying formula 1 prevents the print head from being displaced between the first and each arbitrary following printing stage over a distance of ±(0, 3, 6, . . . ) pixel rows, as a result of which the ink drops printed in one pixel row would originate from the same nozzle (shift distance=0) or a nozzle having substantially the same deviation (shift distance is 3, 6 etc.). This prevents any deviations of nozzles from being propagated in the direction of a pixel row.

BRIEF DESCRIPTION OF THE DRAWINGS

The present invention will now be explained in detail with reference to the accompanying drawings, wherein.

DETAILED DESCRIPTION OF THE INVENTION

Figure 1:
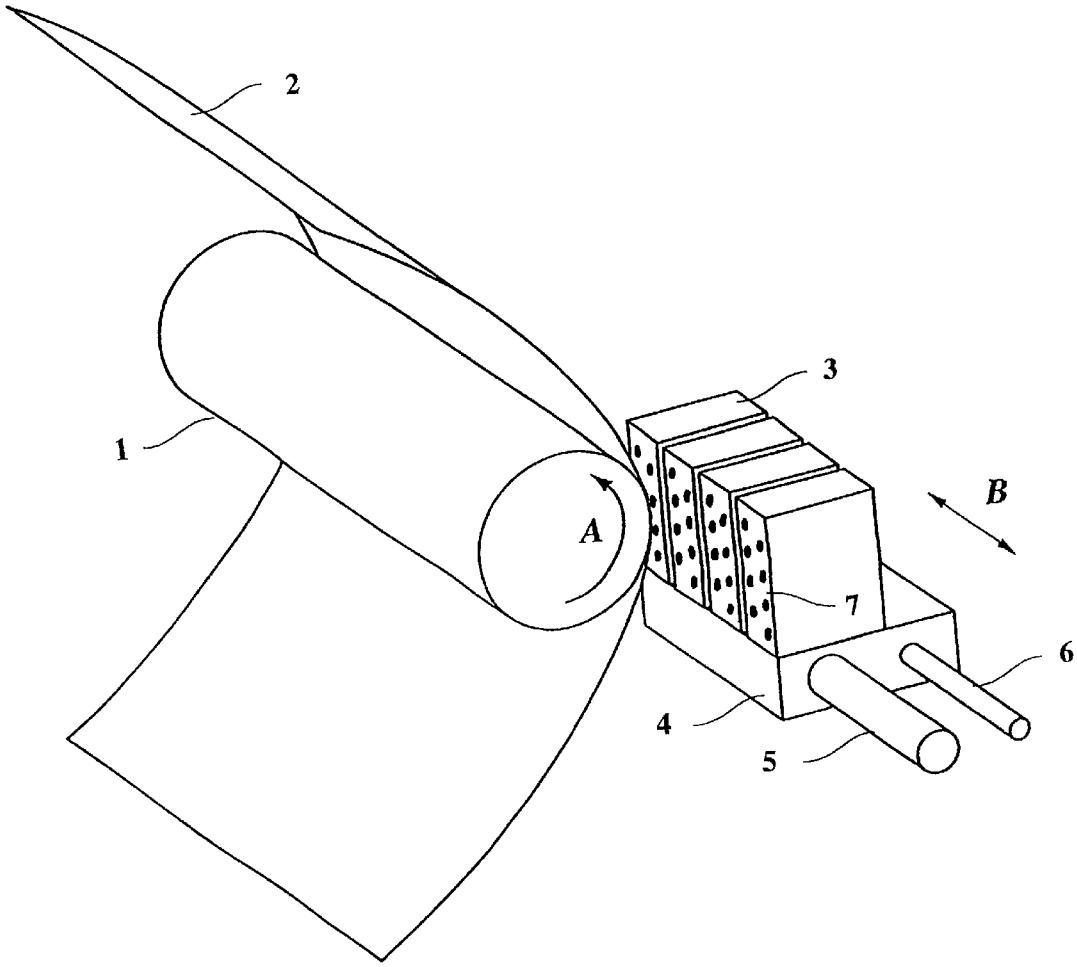
FIG. 1 is an example of a printing device provided with ink ducts.

FIG. 1 shows a printing device provided with ink ducts according to an embodiment of the present invention. In this embodiment, the printing device comprises a roller 1 for supporting a substrate 2 for movement along the four print heads 3. The roller 1 is rotatable about its axis as indicated by arrow A. A scanning carriage 4 carries the four print heads 3 and can be moved in reciprocation in the direction indicated by the double arrow B, parallel to roller 1. In this way the print heads 3 can scan the receiving substrate 2, e.g. a sheet of paper. The carriage 4 is guided on rods 5 and 6 and is driven by suitable means (not shown).

In the embodiment as illustrated in the drawing, each print head comprises eight ink ducts, each with its own nozzle 7, which form two rows of four nozzles each perpendicular to the axis of roller 1. In a practical embodiment of a printing device, the number of ink ducts per print head will be many times greater. Each ink duct is provided with means for activating the ink duct (not shown) and an associated electrical drive circuit (not shown). In this way, the ink duct, the means for actuating the ink duct, and the drive circuit form a unit which can be used for ejecting ink drops in the direction of roller 1. If the ink ducts are activated image-wise, an image forms which is built up of ink drops on the substrate 2.

When a substrate is printed with a printing device of this kind, in which ink drops are ejected from ink ducts, the substrate or part of the substrate is (imaginarily) divided up into a number of fixed locations which form a regular field of pixel rows and pixel columns. In one embodiment, the pixel rows are perpendicular to the pixel columns. The resulting separate locations can each be provided with one or more ink drops. The number of locations per unit of length in the directions parallel to the pixel rows and pixel columns is termed the resolution of the printed image, indicated, for example, as 400×600 d.p.i. ("dots per inch"). By activating one row of nozzles of a print head image-wise when the print head moves over a strip of the substrate in a direction substantially parallel to the pixel rows, the row of nozzles being substantially parallel to the pixel columns, as shown in FIG. 1, there forms on the substrate an image built up from ink drops.

Figure 2:
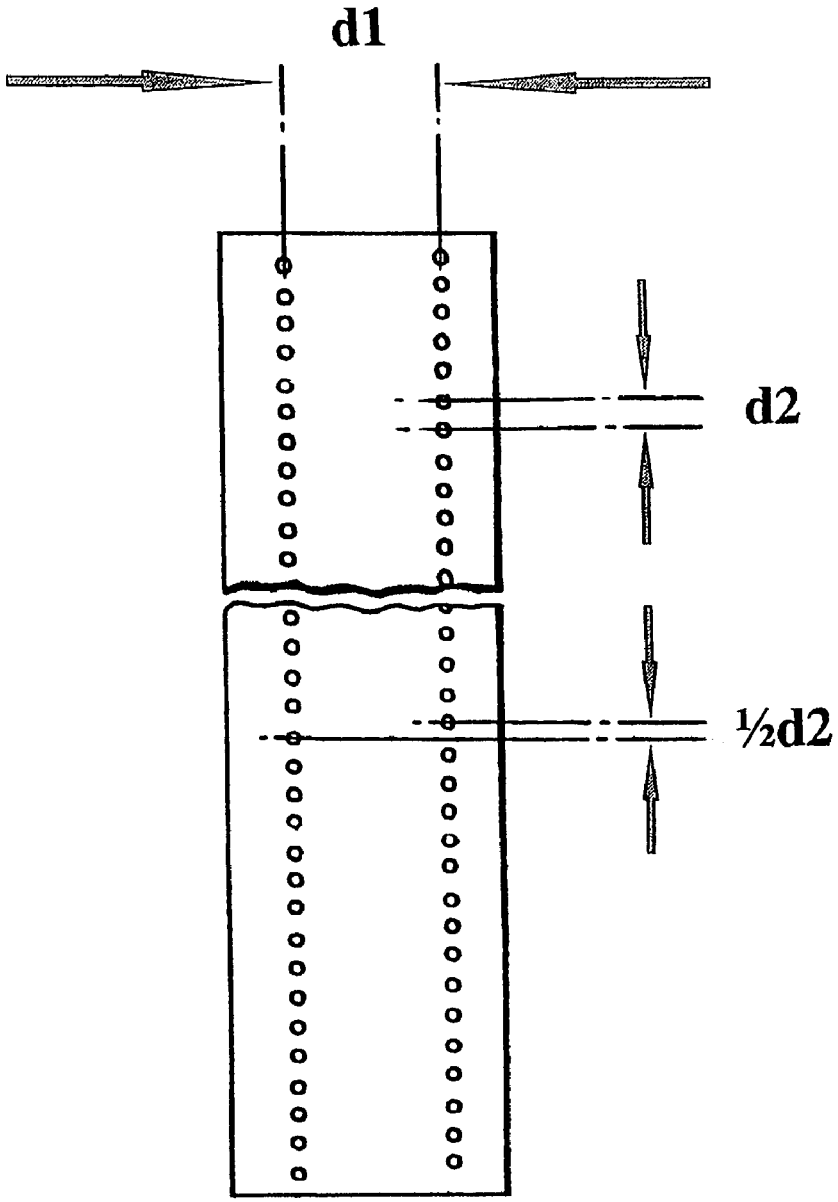
FIG. 2 shows the front of a print head.

FIG. 2 shows the front of a print head provided with a number of nozzles, shown on a larger enlarged scale. In this example, the print head consists of two rows of 100 nozzles each occupying a distance d1 (typically a few millimeters)

from one another. The nozzles within one row are spaced apart by an amount d2 equal to 1/150th inch. This means that the resolution of a row of nozzles is 150 n.p.i. By positioning the two rows with respect to each other such that consecutive nozzles are spaced apart by ½d2 (in the direction substantially parallel to the rows), the resulting print head has a resolution of 300 n.p.i.

Figure 3A:
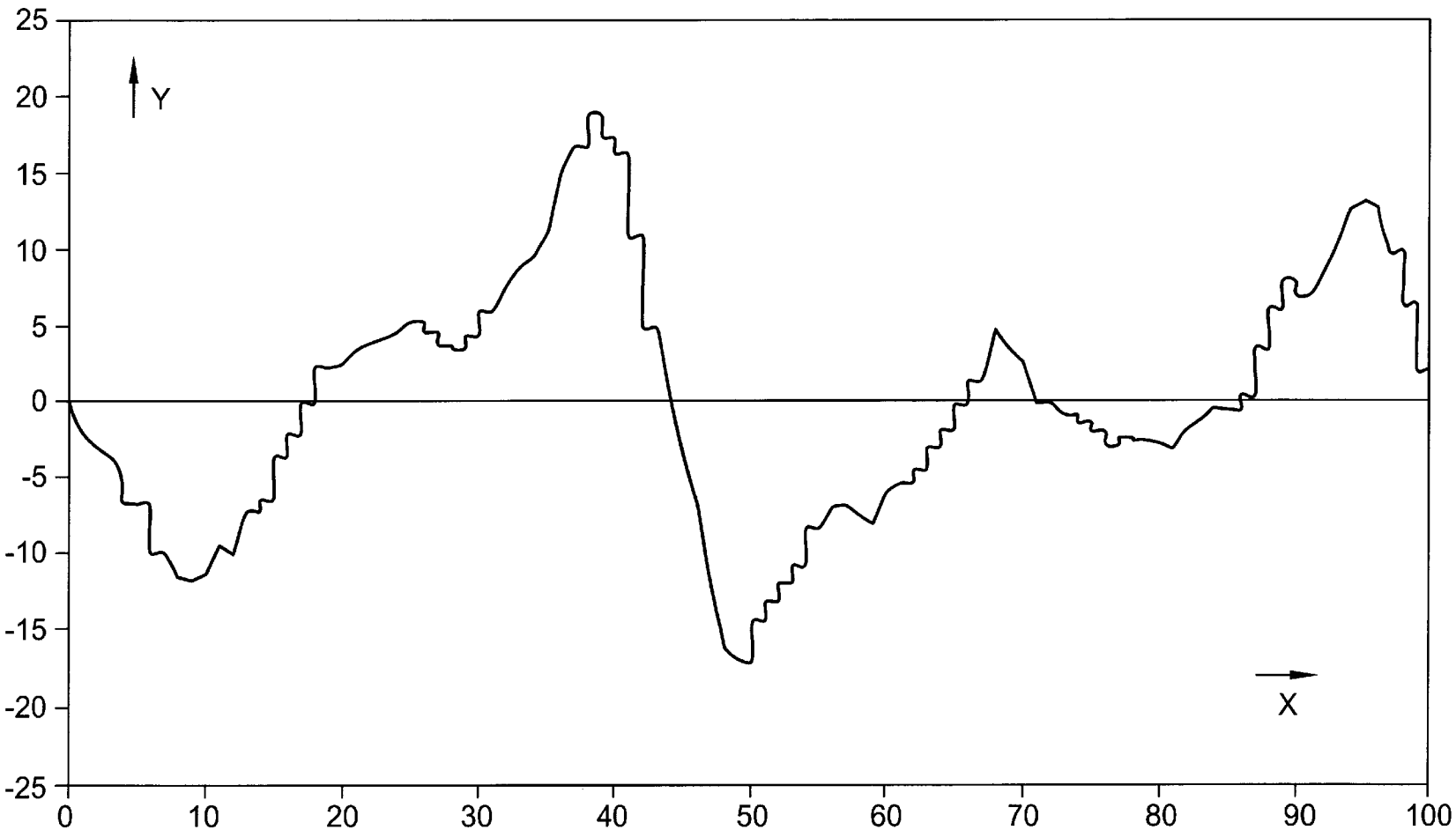
FIGS. 3A and 3B show deviation patterns of the nozzles belonging to one row of a print head.
Figure 3B:
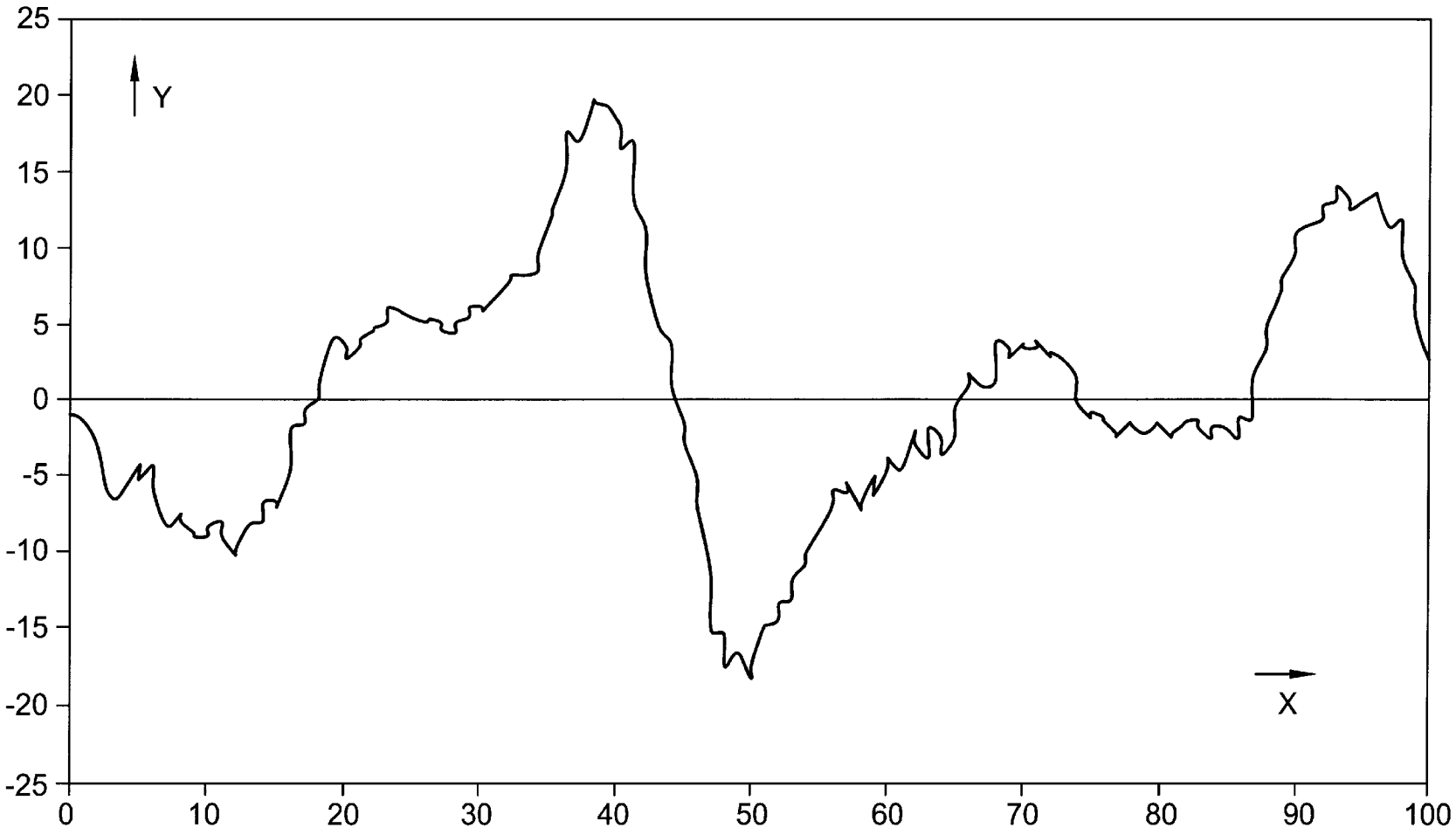

FIGS. 3A and 3B show a deviation pattern of the nozzles belonging to one row of a specific print head, in this example, a pattern of skewed jets. The associated print head is built up of two rows of 100 nozzles each having a resolution of 75 n.p.i. This means that with a print head of this kind, in one printing stage, a strip can be printed in a width of 100/75=1.33 inches with a resolution of 150 d.p.i.

FIG. 3A shows against the ink duct number (plotted on the x-axis), the distance in micrometers by which an ink drop deviates from its normal position, i.e. the position which an ink drop would occupy on the substrate if it were printed exactly in the center of a location. A positive value is equivalent to a net deviation which is the result of the ejection of an ink drop at a positive angle, while a negative value is the result of the ejection of an ink drop at a negative angle. The relationship shown in this drawing clarifies the fact that the deviations exhibited by the nozzles forming part of one row are not independent of one another but that they form a slowly progressing function, in this case a function having a number of peaks and troughs. over the length of the row. The cause of this sinusoidal relationship is not completely clear but is probably due to the method of producing the print heads. It is quite likely that a different production method would result in a different deviation pattern. Thus a possible pattern is one in which the deviation becomes monotonously larger or smaller as a function of the nozzle number. Also, a pattern in which each nozzle has a deviation independent of its neighboring (adjoining) nozzles—what is known as a random deviation for each nozzle—is possible, for example, if each nozzle of a row is made with an individual instrument or in an individual machining step. This regularity of itself is sufficient to enable the method according to the present invention to be successfully applied, also because in that case too, the deviation of an individual nozzle must be prevented from propagating in the direction of a pixel row.

FIG. 3B shows the same relationship for the associated print head, again after the print head has been used for printing substrates for a period of 20 hours spread over a period of 2 weeks. It will be seen that the deviations of the individual nozzles are still substantially the same after these two weeks.

Figure 4:
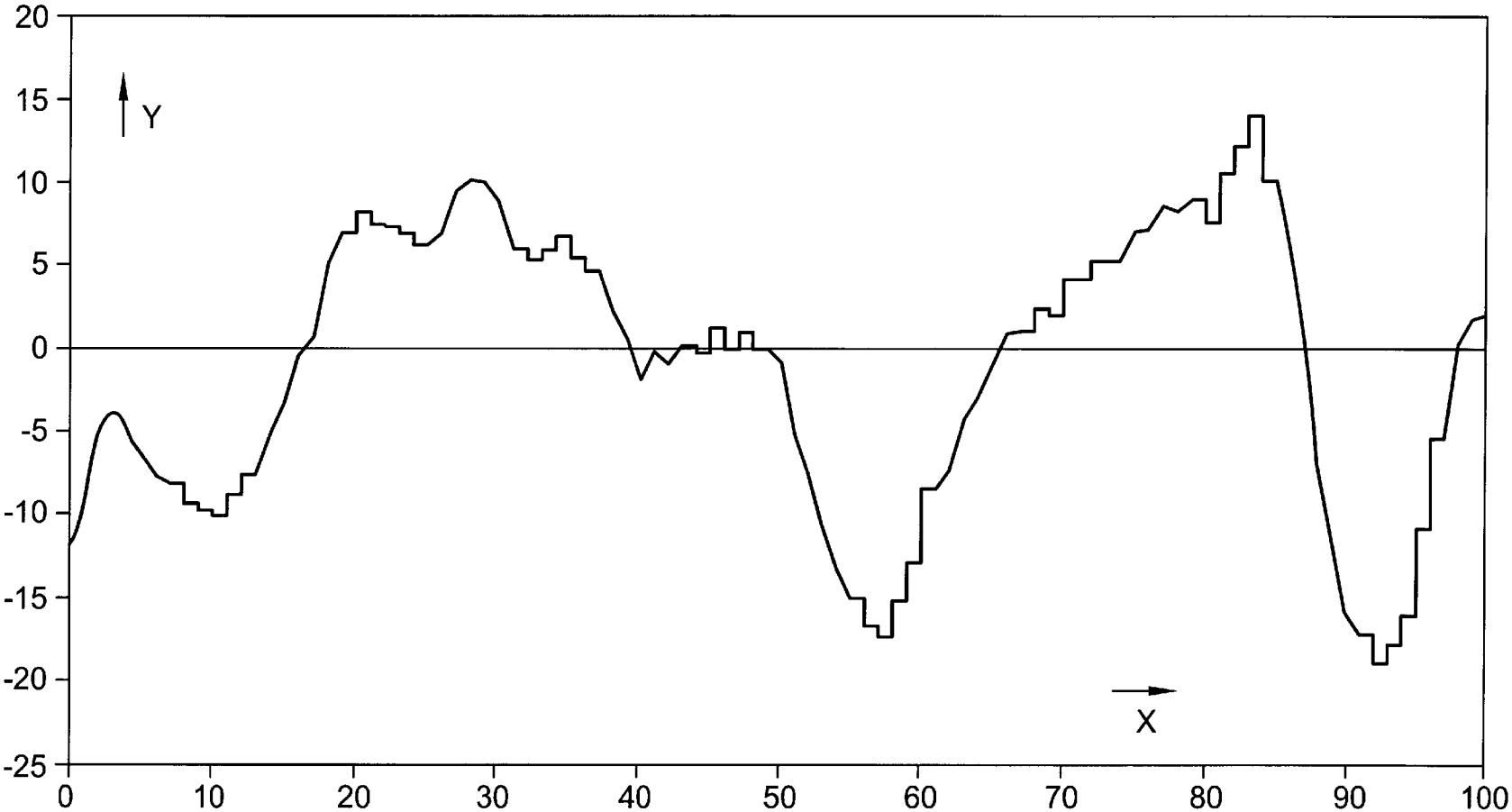
FIG. 4 is the corresponding deviation pattern of the other row of nozzles of the print head as described in the example relating to FIG. 3.

FIG. 4 shows the corresponding deviation pattern of the other row of nozzles of the print head as described in the example relating to FIG. 3. It is apparent from FIG. 4 that the deviation pattern of this second row differs greatly from the deviation pattern of the first row.

Figure 5:
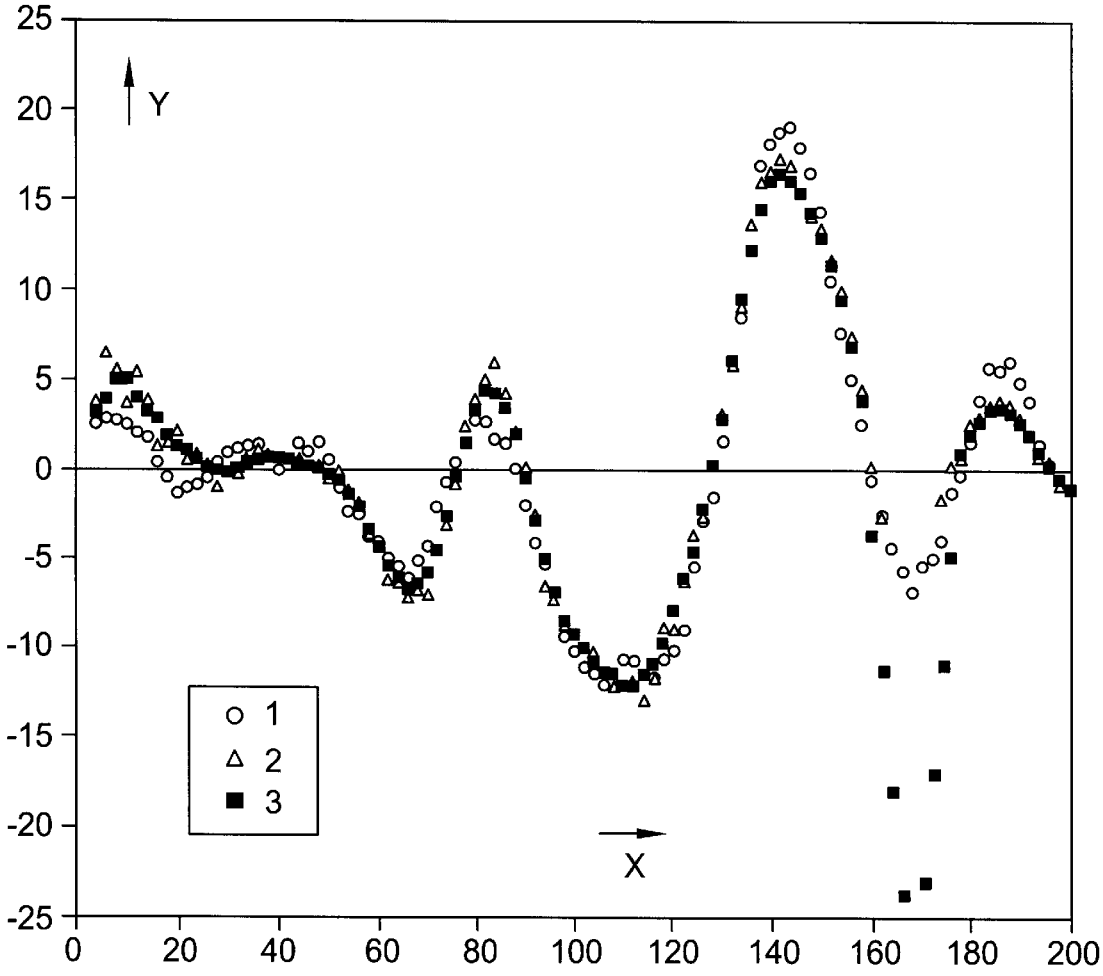
FIG. 5 shows that corresponding nozzles of corresponding rows of print heads produced in a comparable manner may have substantially the same deviations.

FIG. 5 clearly shows that corresponding rows of nozzles of print heads made in a comparable manner, may, to a significant extent, have the same deviation pattern. In the drawing this is shown for three different print heads 1, 2 and 3 of the type described in the example relating to FIG. 3. In FIG. 5, for each of the three print heads (which comprise 200 nozzles distributed over two rows) there is plotted against the nozzle number (shown on the x-axis), the width of a printed line in a direction parallel to the pixel rows in micrometers (shown on the y-axis), which is formed by ink drops originating from two successive nozzles (which in turn belong to two different rows) in accordance with a printing strategy as illustrated in FIGS. 6*a* and 6*b,* which are discussed hereinafter.

Figure 6A:
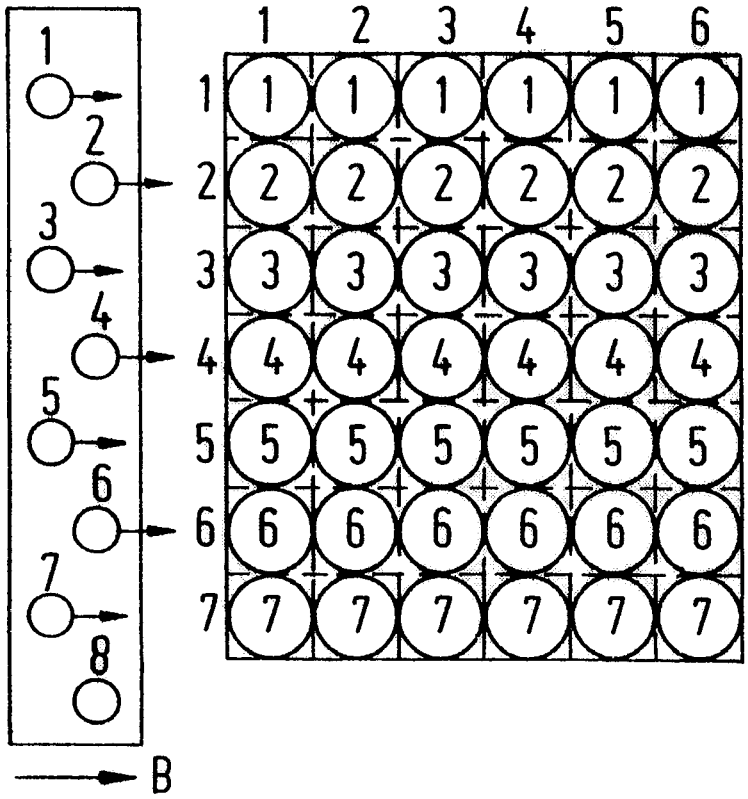
FIGS. 6*a* and 6*b* illustrate what the visible effect may be of nozzle deviations.
Figure 6B:
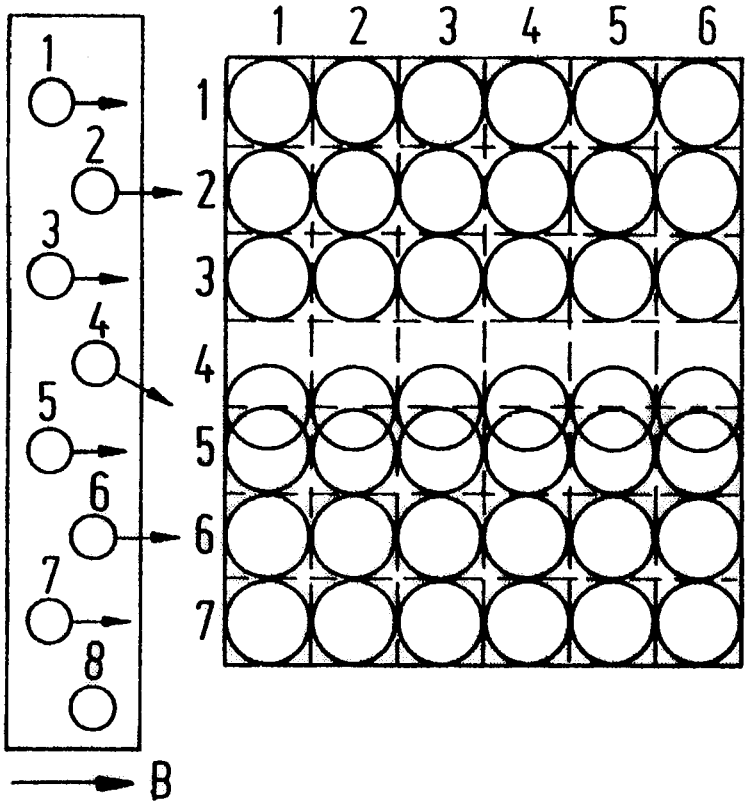

FIG. 6*b* can be used to explain how a variation in width of a 2-pixel line of this kind can be obtained. If, for example, the line width is measured of the 2-pixel line printed by ink drops originating from nozzles 1 (first nozzle of row 1) and 2 (first nozzle of row 2), this line will have an average width. The line printed by the nozzles 2 (first nozzle of row 2) and 3 (second nozzle of row 1) will also have an average width. On the other hand, a line printed by the nozzles 3 and 4 will have a different width which, in this example, is larger than average (this is indicated in FIG. 5 with a positive value in micrometers). The line printed by the nozzles 4 and 5 will, in this example, have a width less than average (in FIG. 5 this is indicated by a negative value in micrometers). Lines printed by nozzles and 6, and finally the nozzles 6 and 7, will have a width equal to the average. Analysis of the three print heads 1, 2 and 3 gives the image shown in FIG. 5.

It will be seen from FIG. 5 that the three print heads, to a significant extent, have the same deviations as a function of the nozzle number. Since the two rows of nozzles within each print head exhibit a deviation pattern independent of one another (FIGS. 3A, 3B and 4), this means that the equality between the three heads must be the result of substantially equal deviation patterns of the corresponding rows of the three print heads.

FIGS. 6*a* and 6*b* show the visible effect of deviations of the nozzles if no correcting steps are taken. This example makes use of a print head built up of two rows of nozzles each having half the required printing resolution (p=2) and each provided with 4 nozzles. The first row consists of the nozzles 1, 3, 5 and 7, and the second row of the nozzles 2, 4, 6 and 8. The required printing resolution is obtained by offsetting the rows with respect to one another in the print head.

FIG. 6*a* shows how, with this print head, it is possible to print a part of a substrate of a size of 7 (pixel rows)×6(pixel columns)=42 locations in a single-pass printing strategy. In this printing strategy, a print head moves only once over the part of the substrate for printing and the entire image is formed in that printing stage. In this example, the image consists of a solid surface. Assume that all the nozzles eject ink drops correctly (this is indicated in FIG. 6*a* by the small horizontal directional arrows originating from each nozzle). If the print head is moved over the substrate in the direction indicated by B and the ink ducts belonging to the nozzles 1–7 are activated image-wise, the resulting image is as shown in FIG. 6*a.* The nozzle of origin is indicated in the printed ink drops.

Assuming that nozzle 4 has a slight deviation so that ink drops are ejected at an angle deviating from the normal axis, as indicated by the small directional arrow at that nozzle in FIG. 6*b,* and that the other nozzles do not exhibit any deviation (this is assumed for reasons of simplification), when the associated part of the substrate is printed with the same printing strategy as described above, the resulting image is as shown in FIG. 6*b.* It will be seen that a linear fault occurs in the image due to the propagation of the printing fault as a result of the deviation of nozzle 4. The human eye is very sensitive to such faults and the latter are therefore very disturbing in a printed image.

Figure 7A:
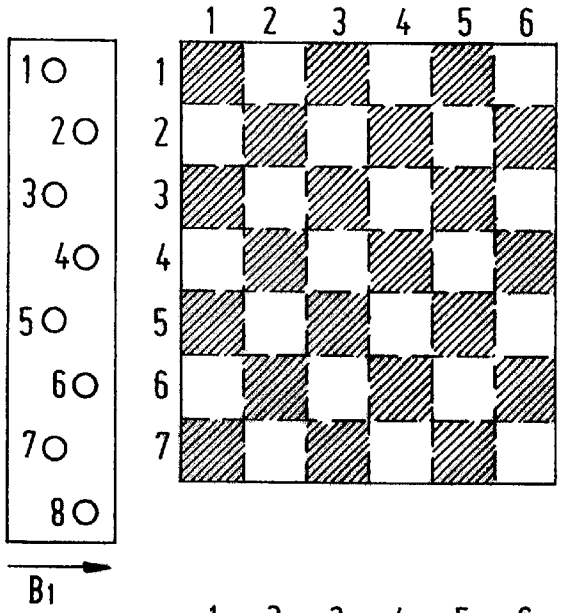
FIGS. 7*a,* 7*b* and 7*c* show an example of the method according to the present invention.

FIG. 7 gives an example of the method of printing a substrate according to the invention. The printing strategy will be explained by reference to a print head as described in the example of FIGS. 6*a* and 6*b.* Just as in the known method, a substrate is printed in a number of stages, i.e. a "multi-pass" strategy, part of the image formed by using a dilution pattern being printed in each stage. The diluted images printed in each stage complement one another so that upon completion of these stages the total image is formed. In the example described here, we shall, for the sake of simplicity, assume a two-stage strategy, in which the sub-images are printed in accordance with what is known as a chessboard pattern. FIG. 7*a* shows by shading of the relevant locations what part of the substrate can be printed when the print head moves in the direction B1 over the substrate in the first stage, the nozzles 1–7 corresponding to the pixel rows 1–7. The locations in the first pixel row can be successively provided with an ink drop originating from nozzle 1, the locations in the second pixel row can be successively provided with ink drops originating from nozzle 2, and so on. When the print head has completely passed the substrate, the print head is displaced with respect to the substrate by a distance which satisfies formula 1. If k is equal to 0, this means that the print head must be displaced over a distance of one pixel row (positively or negatively), so that in the case of a positive shift the nozzles 2–8 correspond to the pixel rows 1–7. The print head is then moved in the direction B2 over the substrate, when the complementary part of the dilution pattern can be printed.

Figure 7B:
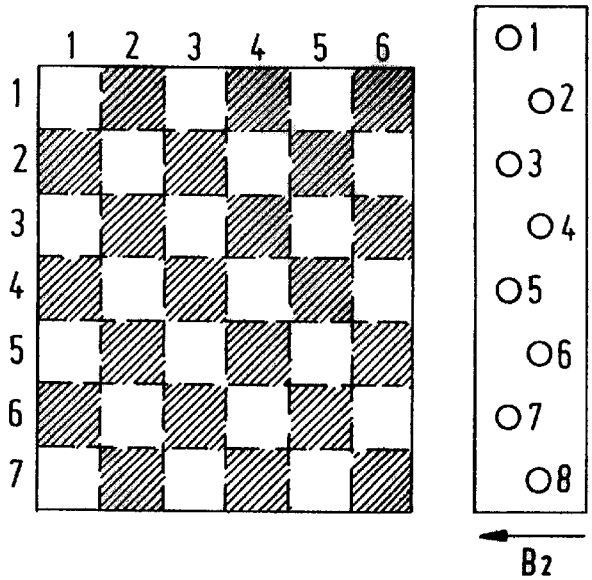
Figure 7C:
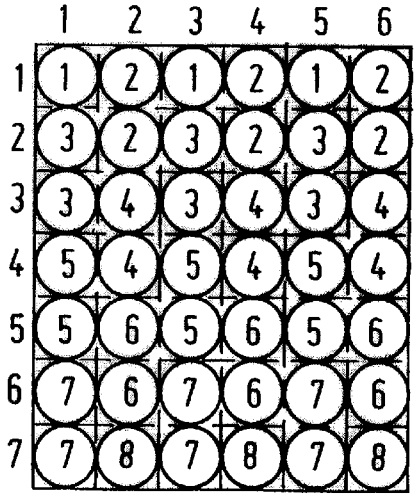

If the image in the relevant part of the substrate consists of a solid surface, then the ink drop distribution obtained is as indicated in FIG. 7*c*. It will be seen here that the ink drops in the first pixel row originate from the nozzles 1 and 2, which in a real print head may have deviations which are independent of one another.

The method according to the invention would also be usable in that case by displacing the print head prior to the second printing stage, not over a distance of −1 or 1 pixel row (k=0), but over a distance of, for example, −3 or 3 (k=1) pixel rows. Although displacement over a greater distance than 1 pixel row in this case results in it not being possible to provide ink drops for all the pixel rows in the second printing stage, since a substrate is normally built up of a number of adjacent strips, these missing ink drops can be printed in a previous or later printing stage. Printing strategies of overlapping strips are public knowledge.

Figure 8A:
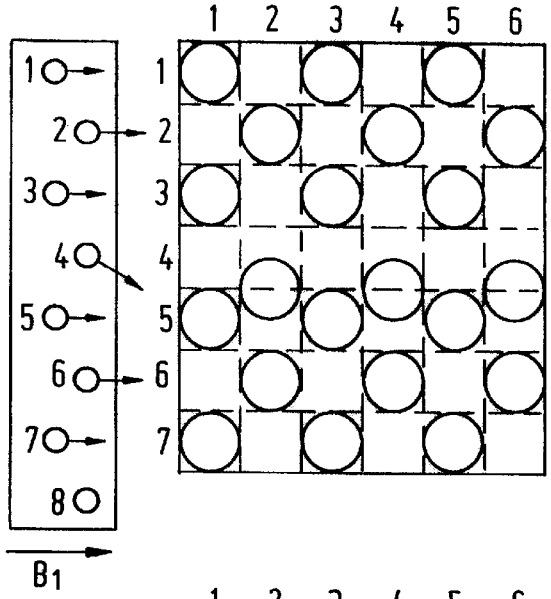
FIGS. 8*a,* 8*b* and 8*c* show the way in which visible effects of nozzle deviations can be masked using the method according to the present invention.
Figure 8B:
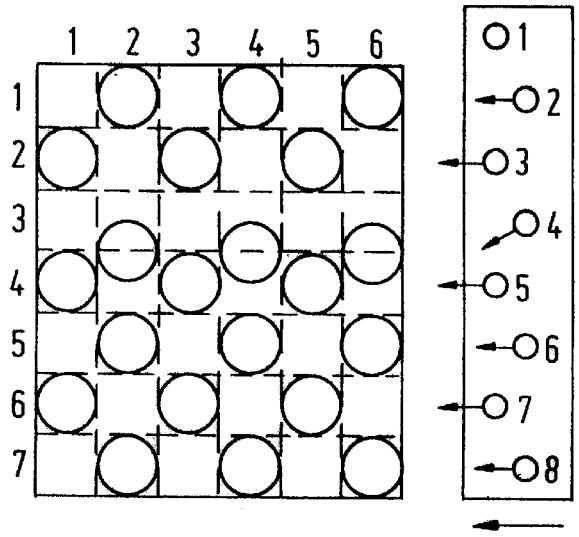
Figure 8C:
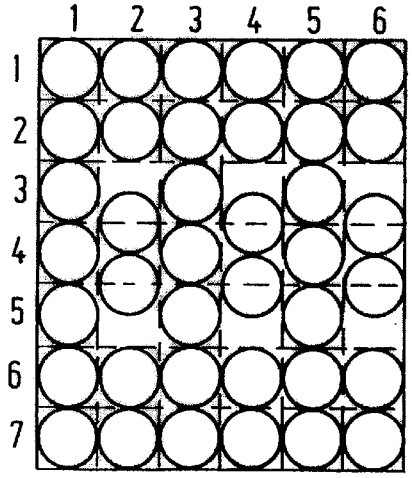

FIGS. 8*a*, 8*b* and 8*c* show the way in which visible effects of nozzle deviations can be masked using the method according to the present invention. The method as described in FIGS. 7*a* and 7*b* is applied in this example to the print head as described in connection with FIG. 6*b*, i.e. the print head having a deviant nozzle 4. In this example the image consists of a solid surface. FIG. 8*a* shows the sub-image forming in the first stage using the chessboard pattern as shown in FIG. 7*a*. FIG. 8*b* shows the sub-image forming in the second stage, the print head being displaced by a distance equivalent to one pixel row. In FIG. 8*c* the two sub-images are combined.

By the use of the method according to the present invention the ink drops with a deviation are no longer situated next to one another in one pixel row as shown in FIG. 6*b*, but are situated in pairs one under the other distributed over the pixel columns 2, 4 and 6. In other words, the linear fault is interrupted in the horizontal direction and the ink drops positioned with the deviation are distributed uniformly over a number of pixel columns. By use of the fact that nozzle 4 always ejects an ink drop at the same deviant angle, a uniform fault distribution can be obtained, i.e. one which is scarcely visible if at all. For this purpose, the shift for the start of the second printing stage does not have to be chosen at random as in the method known from U.S. Pat. No. 5,640,183, but all that is required is a fixed shift, the distance in this case being equal to the width of one pixel row.

It is preferable to keep the displacement distance small, and particularly such that the k is smaller than or equal to 20, since the masking of a deviant ink drop is all the better, the better the ink drop situated above or below said drop corresponds thereto. If the deviation curve is very small or forms a regular pattern, the displacement distance for obtaining good masking may also be large. If the deviation curve within a row of nozzles is, for example, substantially sinusoidal, then the shift can also take place over distances substantially equal to a number of times the period of the sine.

Figure 9:
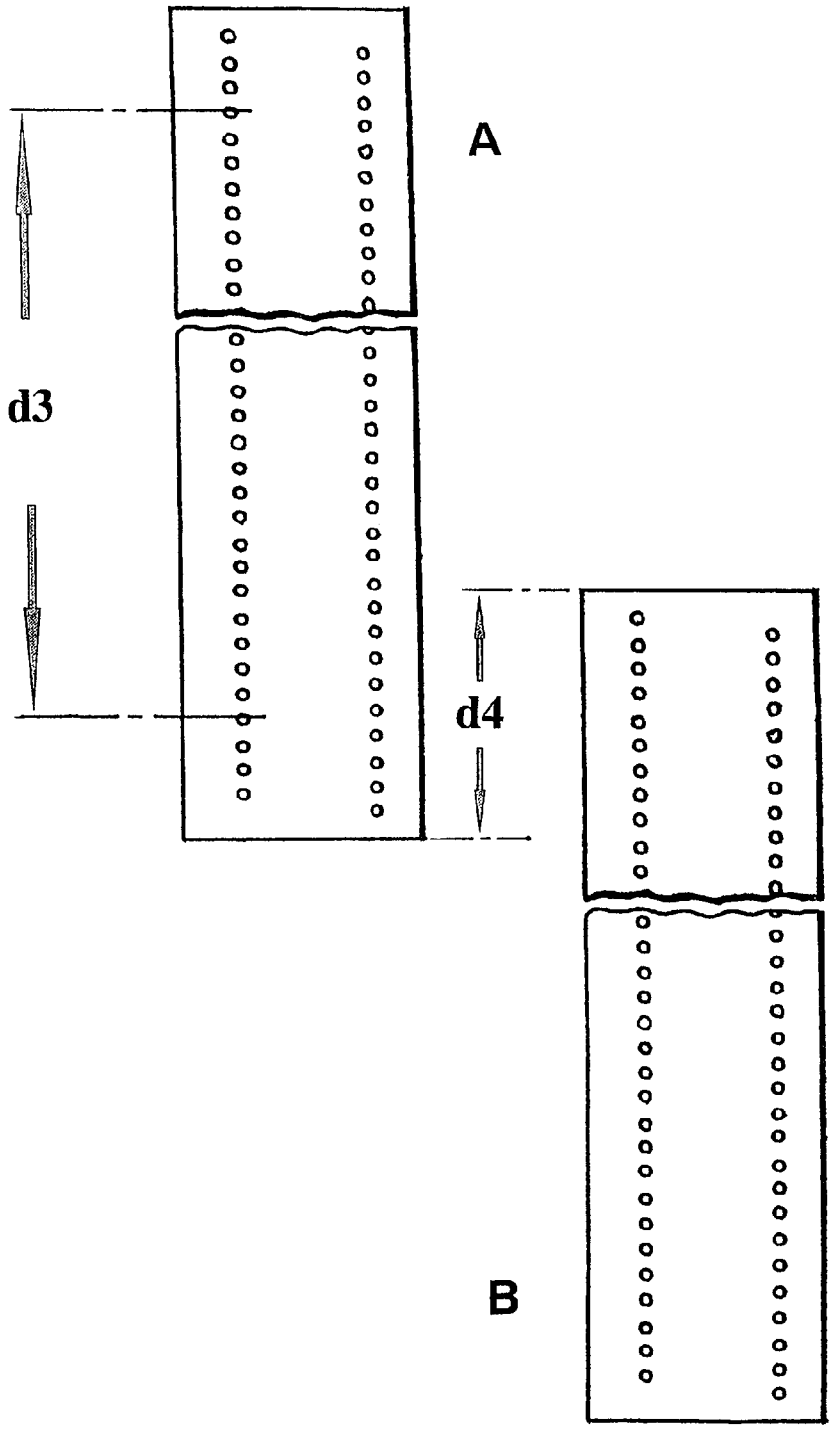
FIG. 9 shows a printing device adapted for use with the method according to the present invention.

FIG. 9 gives an example of a printing device adapted for use with the method according to the present invention. This printing device comprises a number of print heads, two in this case, for printing one image, for example the black color image in a full-color image, by means of a two-step printing strategy in which two complementary images are formed by using a chessboard pattern. In this example too, each print head consists of two rows of nozzles, each with a resolution equal to half the required printing resolution.

In a printing device of this kind, in which more than one print head can be used for printing an image and the print heads have deviation patterns which correspond to a significant degree, it is preferable to print the different sub-images with separate print heads. As a result of the correspondence of the deviation patterns, this does not have any adverse effects on the masking of any deviant ink drops. The advantage of this method is that a shift of a following print head with respect to the position occupied with respect to the substrate by a previous print head during a previous printing stage can be obtained already by arranging the associated two print heads offset from one another in accordance with formula 1 in the printing device scanning carriage. Since it is in principle sufficient to select one fixed shift for printing the complementary image, this arrangement can be fixed (so that the two print heads, in actual fact, form one combined print head). The correct arrangement of the two print heads can be effected as follows: the first print head A is placed in the printing device and a strip of width d3 is printed on a substrate as shown in FIG. 9. It is not of great importance which series of successive nozzles are selected for this from print head A and how wide the strip is (in other words how many nozzles are used). In practice, a strip of a width of 90% of the length of a row of nozzles is frequently printed, a number of nozzles remaining unused both at the bottom of each row and at the top. The second print head B is then placed in the printing device, there being a certain overlap d4 with the first print head, so that at least the first nozzle of print head B overlaps the part of print head A with which said previous strip was printed.

With this first arrangement, a solid surface is printed on a substrate, print head A always printing a strip in accordance with a chessboard pattern, whereafter the substrate is displaced with respect to the two print heads over a distance d3 (so that print head B is situated above the previously printed strip) and then with print head B the complementary image of the solid surface is printed on the associated strip. In this way the entire substrate is printed strip by strip. In the case of a print head having 200 nozzles distributed over 2 rows and a resolution of 300 n.p.i., each strip has a width of ⅔ inches=1.69 cm. Thus 29.7/1.69=17.5 strips are required to print an A4 format substrate (in the longitudinal direction). After the substrate has been printed, a check is made whether visible linear deviations are present in the image. If not, then obviously all the pixel rows have been printed with ink drops originating from nozzles which exhibit different deviations, and the arrangement of the two print heads meets the requirements for an arrangement for using the method according to the invention. If there are linear deviations, then the arrangement in this case obviously does not meet requirements and print head B must be displaced. In this case a shift over a distance of one pixel row is sufficient. The net shift of print head B with respect to print head A in the case of a shift over one pixel row may, however, be more than one pixel row. This depends on the initial arrangement of the print heads A and B with respect to one another. Finally, the arrangement of the two print heads is fixed in the printing device.

Figure 10:
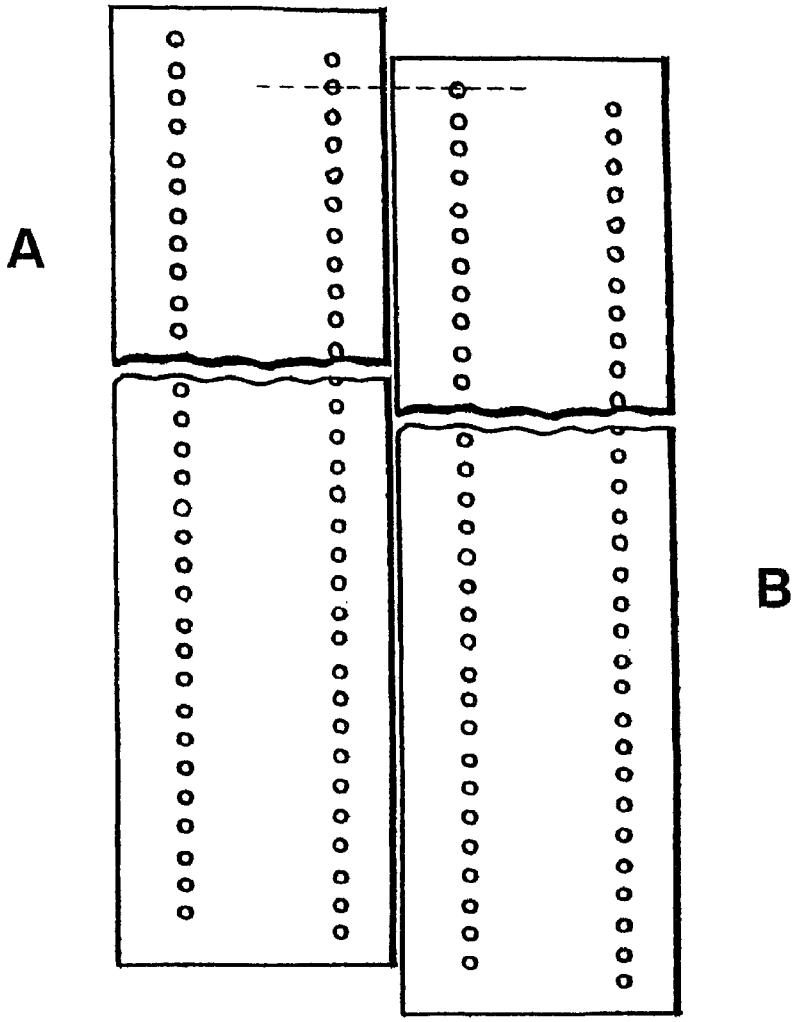
FIG. 10 is a second example of a printing device adapted for use with the method according to the present invention.

FIG. 10 gives a following example of a printing device adapted for use with the method according to the present invention. This printing device comprises two print heads with a resolution of 300 n.p.i., which print heads are combined from two rows of nozzles with a resolution of 150 n.p.i. The image for printing has a resolution of 300 d.p.i. in the direction parallel to the rows of nozzles. If the image is printed by printing two complementary diluted images to a chessboard pattern, the first sub-image can be printed with head A and the second with head B. To prevent linear deviations from forming in the image, head B will have to be displaced with respect to head A over a number of pixel rows indicated by formula 1. Since p=2, this number of rows can be selected from the set of positive and negative uneven numbers. If this number is selected as being equal to −3, then head B, in printing the second sub-image, will have to be displaced with respect to head A over a distance equal to the width of −3 pixel rows. This shift can be embodied in the fixed arrangement of the two heads in the scanning carriage as shown in FIG. 10. Nozzle 4 of print head A then corresponds to nozzle 1 of print head B. When the two print heads are now moved simultaneously over a substrate, the two sub-images can be printed in the same printing stage, i.e. during the same movement of the scanning carriage. In this way the printing device has maximum productivity and yet any incorrectly placed drops are masked in accordance with the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing a substrate with an inkjet printing device which utilizes at least one print head provided with at least two rows of nozzles, wherein substantially fixed locations on the substrate, which locations form a regular field of pixel rows and pixel columns, are provided with ink drops image-wise, a resolution of the pixel columns being greater than a resolution of the rows of nozzles so that p, where p is equal to the quotient of the resolution of the pixel columns and the resolution of the rows of nozzles, is an integer greater than or equal to 2, said method comprising:

providing a strip of pixel rows with ink drops in a first printing stage;

displacing the print head in a direction substantially parallel to the pixel columns; and providing the strip of pixel rows with supplementary ink drops in a second printing stage wherein the print head is displaced over a distance which is chosen according to the following criterion:

said distance is equal to the width of a number of pixel rows selected from the set:

$$\pm(i+kp)$$

where i is a set of integers greater than or equal to 1 and less than or equal to (p−1) and k is a natural number.

2. The method according to claim 1, wherein k is a natural number less than or equal to 20.

3. The method according to claim 2, wherein k is a natural number less than or equal to 10.

4. The method according to claim 3, wherein k is a natural number less than or equal to 5.

5. The method according to claim 3, wherein k is equal to 0.

6. The method according to claim 1, wherein the print head used in the first printing stage differs from the print head used in the second printing stage.

7. An inkjet printing device for printing a substrate having at fixed locations a regular field of pixel rows and pixel columns with ink drops image-wise, which device comprises:

at least one print head provided with at least two rows of nozzles, operatively associated with said substrate, a resolution of the pixel columns being greater than a resolution of the rows of nozzles so that p, where p is equal to the quotient of the resolution of the pixel columns and the resolution of the rows of nozzles, is an integer greater than or equal to 2, the device adjusted for printing in a first printing stage a strip of pixel rows with ink drops; and means for displacing the at least one print head in a direction substantially parallel to the pixel columns, the device further adjusted for printing in a second printing stage containing the strip of pixel rows with supplementary ink drops, wherein the print head is displaced over a distance which is chosen according to the following criterion:

said distance is equal to the width of a number of pixel rows selected from the set:

$$\pm(i+kp)$$

where i is a set of integers greater than or equal to 1 and less than or equal to (p−1) and k is a natural number.

8. The printing device according to claim 7, wherein the print head comprises two rows of nozzles.

9. The printing device according to claim 8, wherein the rows of nozzles have a resolution equal to half the resolution of the pixel columns.

10. The printing device according to claim 7, wherein the printing device comprises at least two print heads.

* * * * *